US008854175B2

(12) United States Patent
Wang

(10) Patent No.: US 8,854,175 B2
(45) Date of Patent: Oct. 7, 2014

(54) CHIP RESISTOR DEVICE AND METHOD FOR FABRICATING THE SAME

(71) Applicant: Ralec Electronic Corporation, Kaohsiung (TW)

(72) Inventor: Wan-Ping Wang, Kaohsiung (TW)

(73) Assignee: Ralec Electronic Corporation, Kaohsiung (TW)

( * ) Notice: Subject to any disclaimer, the term of this patent is extended or adjusted under 35 U.S.C. 154(b) by 0 days.

(21) Appl. No.: 13/790,064

(22) Filed: Mar. 8, 2013

(65) Prior Publication Data

US 2014/0055228 A1 Feb. 27, 2014

(30) Foreign Application Priority Data

Aug. 24, 2012 (TW) ..... 101130806 A

(51) Int. Cl.

| | |
|---|---|
| ***H01C 1/012*** | (2006.01) |
| ***H01C 17/28*** | (2006.01) |
| ***H01C 13/02*** | (2006.01) |
| ***H01C 1/142*** | (2006.01) |
| ***H01C 17/00*** | (2006.01) |

(52) U.S. Cl.

CPC ..... *H01C 17/006* (2013.01); *H01C 17/281* (2013.01); *H01C 13/02* (2013.01); *H01C 1/142* (2013.01)

USPC ..... 338/311; 338/22 R; 338/307; 338/309; 338/332

(58) Field of Classification Search

CPC ..... H01C 1/012; H01C 1/142; H01C 1/032; H01C 7/003; H01C 17/006; H01C 17/288

USPC ..... 338/22 R, 311, 307, 308, 309, 327, 332, 338/323

See application file for complete search history.

(56) References Cited

U.S. PATENT DOCUMENTS

| | | | | |
|---|---|---|---|---|
| 5,024,970 | A * | 6/1991 | Mori | 438/462 |
| 6,166,620 | A * | 12/2000 | Inuzuka et al. | 338/309 |
| 6,703,683 | B2 * | 3/2004 | Tanimura | 257/536 |
| 7,380,333 | B2 * | 6/2008 | Tsukada et al. | 29/610.1 |

FOREIGN PATENT DOCUMENTS

| | | |
|---|---|---|
| CN | 201910306 | 7/2011 |
| TW | 351040 | 10/2011 |

OTHER PUBLICATIONS

Search Report issued to Taiwanese Counterpart Application No. 101130806 on Jan. 22, 2014.

* cited by examiner

*Primary Examiner* — Kyung Lee
(74) *Attorney, Agent, or Firm* — SmithAmundsen LLC; Kelly J. Smith; Dennis S. Schell

(57) ABSTRACT

A chip resistor device includes an insulating substrate, two indented patterns, and a resistor unit. The insulating substrate has opposite first and second surfaces. The first surface has two opposite edges and two electrode forming regions adjacent to the two opposite edges, respectively. The indented patterns are respectively formed in the electrode forming regions of the first surface and indented from the first surface. The resistor unit includes two contact electrodes respectively formed on the electrode forming regions of the first surface and filled into the indented patterns, and a resistor formed on the first surface between the two contact electrodes and electrically contacting the contact electrodes.

3 Claims, 10 Drawing Sheets

CHIP RESISTOR DEVICE AND METHOD FOR FABRICATING THE SAME

CROSS-REFERENCE TO RELATED APPLICATION

This application claims priority of Taiwanese Patent Application No. 101130806, filed on Aug. 24, 2012.

BACKGROUND OF THE INVENTION

1. Field of the Invention

This invention relates to a passive device and a method for fabricating the same, more particularly to a chip resistor device and a method for fabricating the same.

2. Description of the Related Art

FIGS. 1 and 2 illustrate a conventional chip resistor device 1 which has a plurality of passive components for providing a range of resistance. The conventional chip resistor device 1 includes: four resistor units, and an insulating ceramic substrate 11.

The insulating ceramic substrate 11 is a thin plate with a rectangular shape, and has a first surface 111, a second surface 112 opposite to the first surface 111, a pair of opposite short lateral surfaces 113 each of which interconnects short edges of the first and second surfaces 111, 112, and a pair of opposite long lateral surfaces 114 each of which interconnects long edges of the first and second surfaces 111, 112.

Each of the resistor units includes two generally C-shaped and spaced-apart electrodes 12 and a resistor 14. The electrodes 12 of each of the resistor units are respectively formed on the two opposite long lateral surfaces 114, and are spaced apart from the electrodes 12 of the adjacent one of the resistor units. Each of the electrodes 12 of the resistor units has two ends that respectively extend onto the first and second surfaces 111, 112. The resistor 14 of each of the resistor units is formed on the first surface 111, and is disposed between and electrically contacts the corresponding electrodes 12.

In use, the end of each of the electrodes 12 that extends onto the first surface 111 is soldered and electrically contacts a circuit board (not shown) so that the resistor units can provide desired resistances to the circuit board by virtue of the resistor 14 between the two corresponding electrodes 12. That is, the electrical path for each of the resistor units is formed by the ends of the electrodes 12 formed on the first surface 111 and the resistor 14. The parts of the electrodes 12 of each of the resistor units that are formed on the long lateral surfaces 114 and the second surface 112 do not constitute the electrical path but provide adhesion strength between the electrodes 12 and the insulating ceramic substrate 11. However, such electrode design would increase manufacturing costs and results in high temperature coefficient of resistance (TCR). Moreover, in test or in use, collision of the parts of the electrodes 12 formed on the long lateral surfaces 114 and the second surface 112 would also result in malfunction of the chip resistor device 1.

Besides, when the conventional chip resistor device 1 is further miniaturized, a short-circuit problem may occur due to an excessively narrow distance between adjacent ones of the resistor units.

Also, upon manufacturing the conventional chip resistor device 1, pin-holes are formed, which might result in sintering deformation and reduced usable area of the insulating ceramic substrate 11. Take a chip resistor device with 0201×2 size as an example, the proportion of the usable area is merely 15%.

SUMMARY OF THE INVENTION

Therefore, an object of the present invention is to provide a chip resistor device that can overcome the aforesaid drawbacks associated with the prior art.

Accordingly, a chip resistor device of this invention comprises an insulating substrate, two indented patterns, and a resistor unit. The insulating substrate has a first surface and a second surface opposite to the first surface. The first surface has two opposite edges and two electrode forming regions adjacent to the two opposite edges, respectively. The indented patterns are respectively formed in the electrode forming regions of the first surface and are indented from the first surface. The resistor unit includes two contact electrodes and a resistor. The contact electrodes are respectively formed on the electrode forming regions of the first surface and filled into the indented patterns. The resistor is formed on the first surface between the two contact electrodes and electrically contacts the contact electrodes.

Another object of the present invention is to provide a method for fabricating a chip resistor device that can overcome the aforesaid drawbacks associated with the prior art.

Accordingly, the method for fabricating a chip resistor device of this invention, comprises the steps of:

(a) defining a plurality of substrates on an insulating film by a plurality of spaced apart and interlaced splitting grooves, each of the substrates having a first surface and a second surface opposite to the first surface, the first surface having two opposite edges and two electrode forming regions adjacent to the two opposite edges respectively;

(b) forming two indented patterns respectively in the electrode forming regions of the first surface of each of the substrates, the indented patterns being indented from the first surface;

(c) filling a first pasty conductive material into the two indented patterns so as to form two contact electrode growing films on the indented patterns of each of the substrates;

(d) forming a resistor made of a second pasty conductive material on the first surface of each of the substrates between the two contact electrode growing films, the resistor having two opposite ends electrically contacting the contact electrode growing films;

(e) cutting the insulating film along the splitting grooves; and (f) coating the contact electrode growing films of each of the substrates with a conductive material so as to respectively form two electrodes on the electrode forming regions of each of the substrates.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
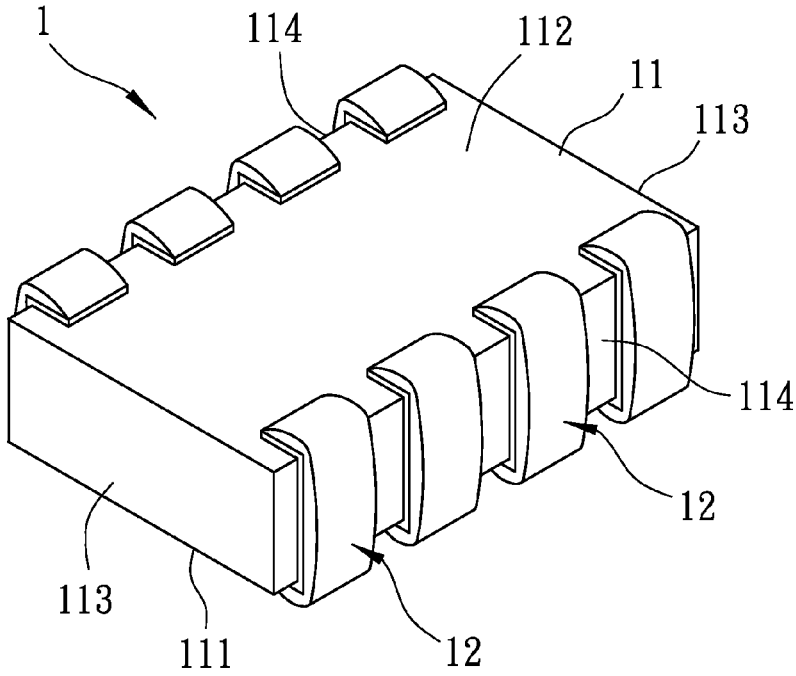
FIG. 1 PRIOR ART
FIG. 1 is a perspective view of a conventional chip resistor device.
Figure 2:
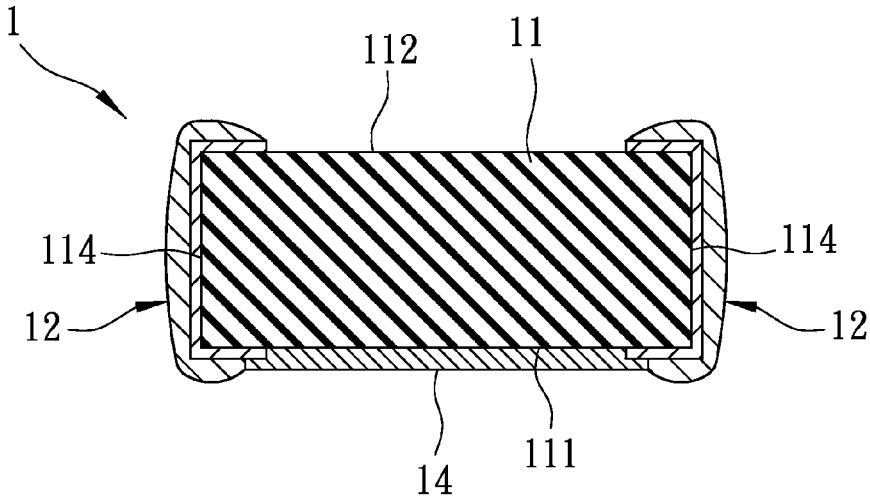
FIG. 2 PRIOR ART
FIG. 2 is a sectional view of the conventional chip resistor device.

Before the present invention is described in greater detail with reference to the accompanying preferred embodiments, it should be noted herein that like elements are denoted by the same reference numerals throughout the disclosure.

Figure 3:
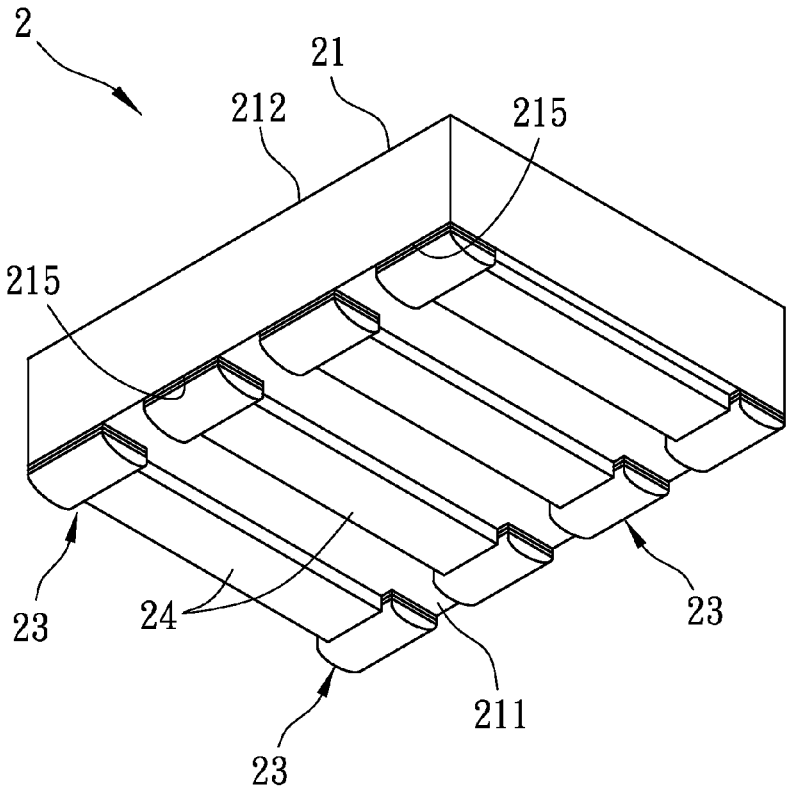
FIG. 3 is a perspective view of a chip resistor device of the first preferred embodiment according to this invention.
Figure 4:
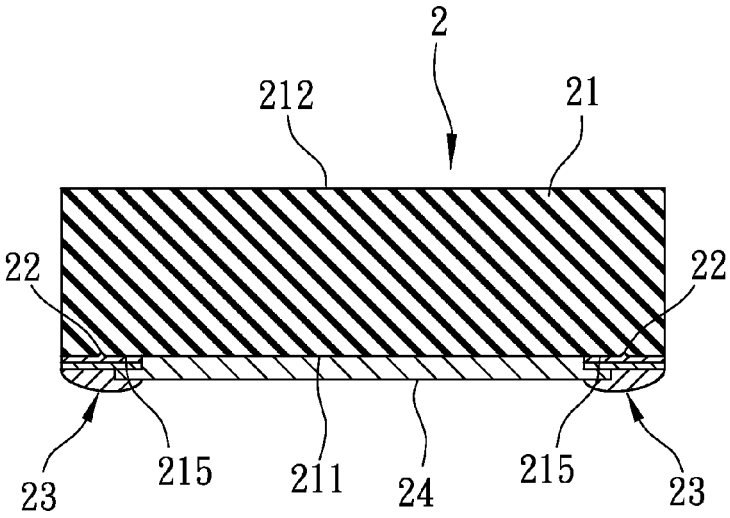
FIG. 4 is a sectional view of the chip resistor device of the first preferred embodiment.

Referring to FIGS. 3 and 4, a chip resistor device 2 of the first preferred embodiment according to this invention includes: an insulating substrate 21, eight indented patterns 22, and four resistor units.

The insulating substrate 21 is made of a material, e.g., aluminum oxide, and is a thin plate with a rectangular shape. The insulating substrate 21 has a first surface 211 and a second surface 212 opposite to the first surface 211. The first surface 211 has two opposite edges and eight spaced apart electrode forming regions 215. The electrode forming regions 215 are adjacent to and arranged along the two opposite edges, respectively.

The indented patterns 22 are respectively formed in the electrode forming regions 215 of the first surface 211 and are indented from the first surface 211. Each of the indented patterns 22 includes at least one notch that is formed using a diamond blade or laser.

Each of the resistor units includes two contact electrodes 23 and a resistor 24. The two contact electrodes 23 of each of the resistor units are respectively formed on the respective two of the electrode forming regions 215 of the first surface 211 and filled into the respective indented patterns 22. The resistor 24 of each of the resistor units is formed on the first surface 211 between the two contact electrodes 23 and electrically contacts the contact electrodes 23.

In use, the contact electrodes 23 of the chip resistor device 2 of this embodiment are soldered to a circuit board (not shown), and the chip resistor device 2 is capable of providing a range of resistances for the circuit board by virtue of the electrical connection between the resistors 24 and the contact electrodes 23 and the electrical connection between the contact electrodes 23 and the circuit board.

Figure 5:
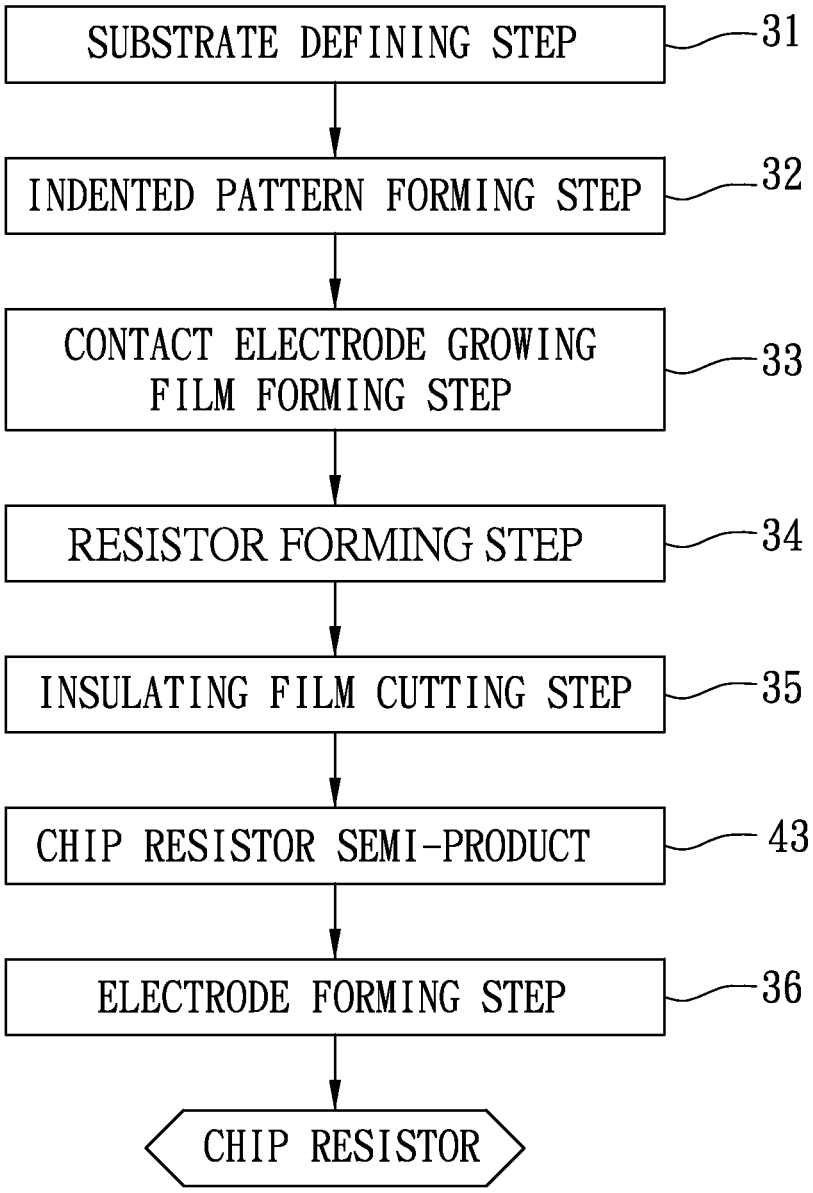
FIG. 5 is a flow chart of a method for fabricating the chip resistor device of the first preferred embodiment according to this invention.

Referring to FIG. 5, a method for fabricating the chip resistor device 2 of the first preferred embodiment according to this invention comprises a substrate defining step 31, an indented pattern forming step 32, a contact electrode growing film forming step 33, a resistor forming step 34, an insulating film cutting step 35, and an electrode forming step 36.

Figure 6:
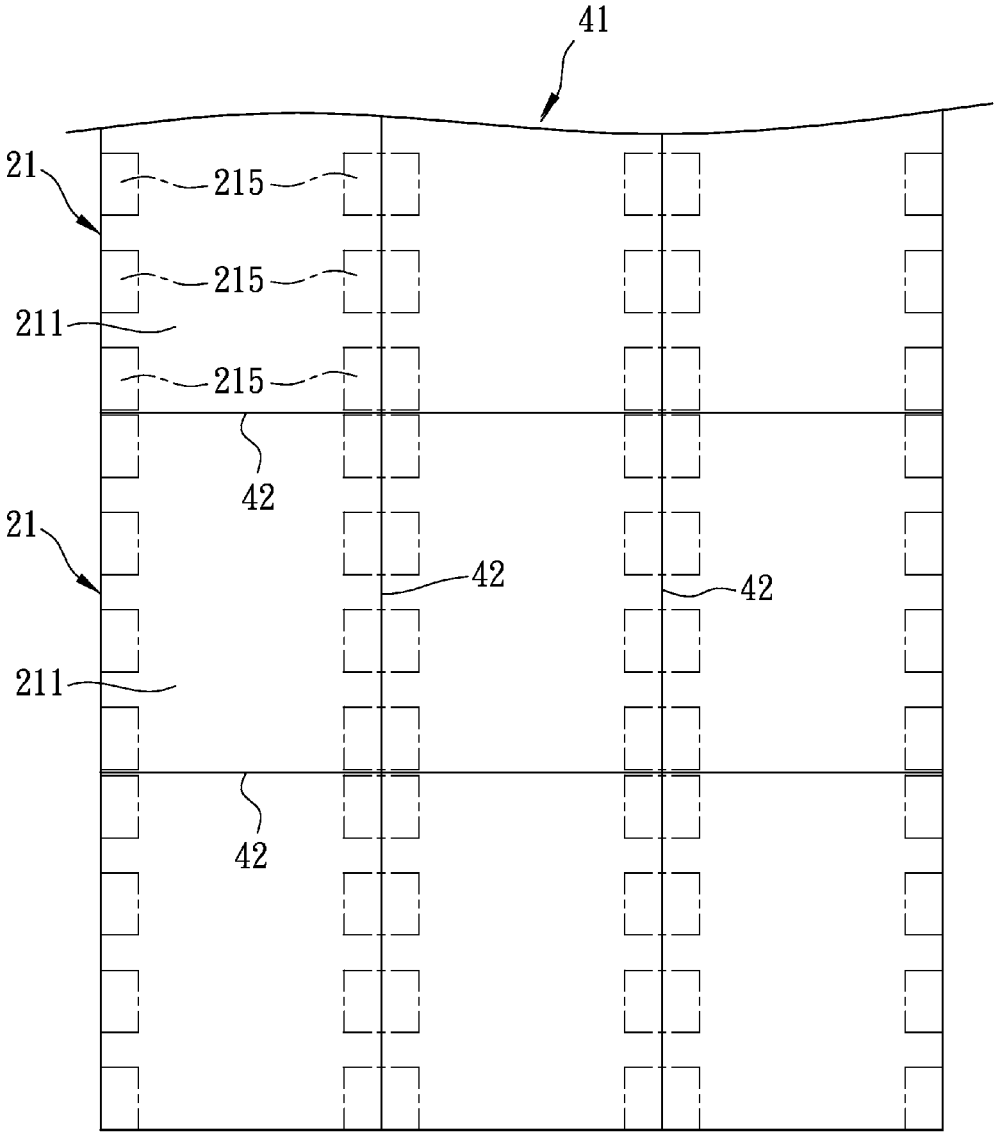
FIG. 6 is a schematic view to illustrate a substrate defining step of the method for fabricating the chip resistor device of the first preferred embodiment.

Referring to FIGS. 5 and 6, in step 31, a plurality of insulating substrates 21 are defined on an insulating film 41 made of an insulating material such as aluminum oxide by a plurality of spaced-apart and interlaced splitting grooves 42. The splitting grooves 42 is formed using a diamond blade or laser. Each of the splitting grooves 42 has a depth shorter than a thickness of the insulating film 41. Each of the insulating substrates 21 has opposite first and second surfaces 211, 212 (see FIG. 7). The first surface 211 of each of the insulating substrates 21 has two opposite edges and four pairs of electrode forming regions 215 disposed adjacent to and along the two opposite edges.

Figure 7:
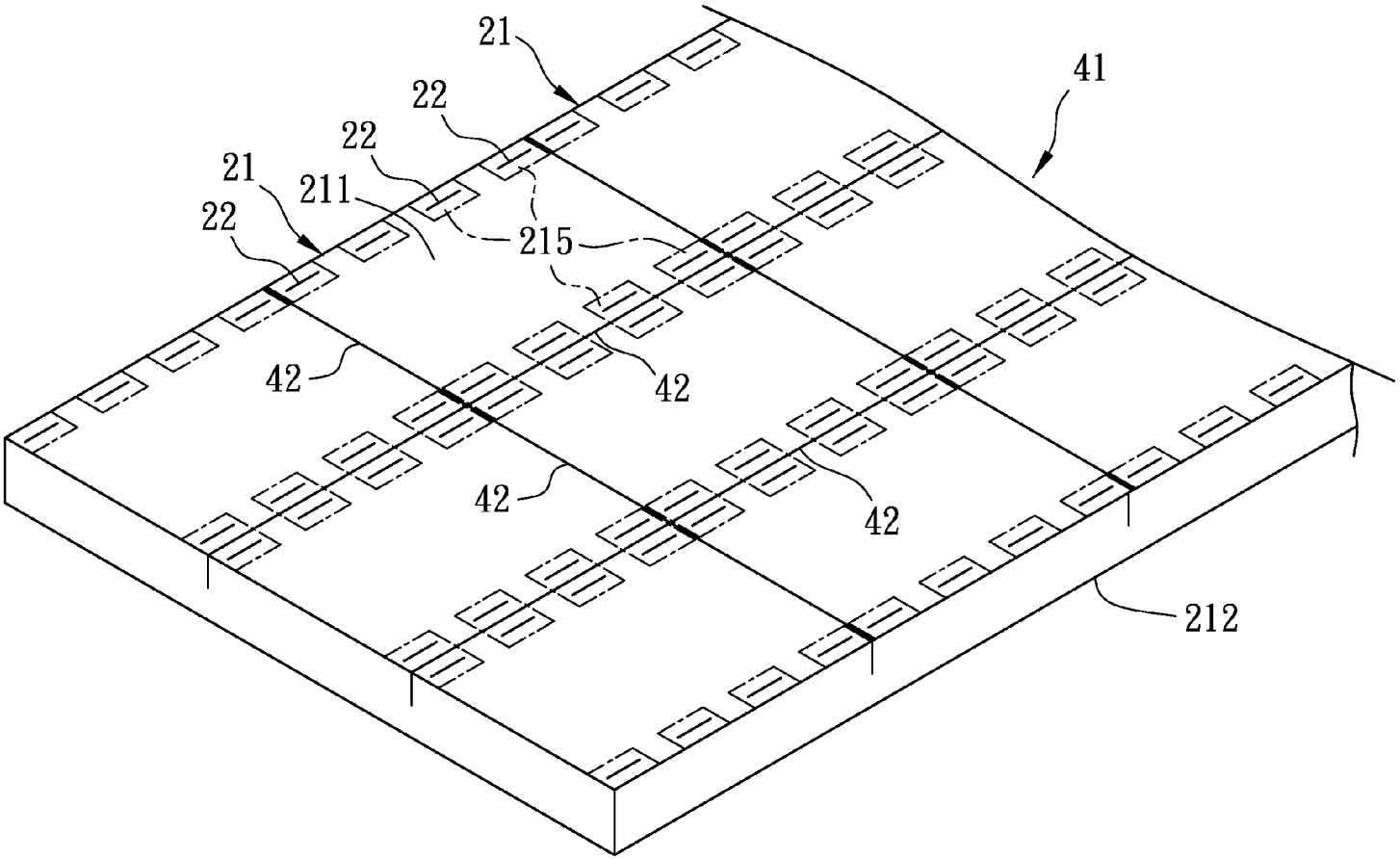
FIG. 7 is a schematic view to illustrate an indented pattern forming step of the method for fabricating the chip resistor device of the first preferred embodiment.

Referring to FIGS. 5 and 7, in step 32, eight indented patterns 22 are respectively formed using a diamond blade or laser in the electrode forming regions 215 of the first surface 211 of each of the substrates 21. The indented patterns 22 are indented from the first surface 211.

Figure 8:
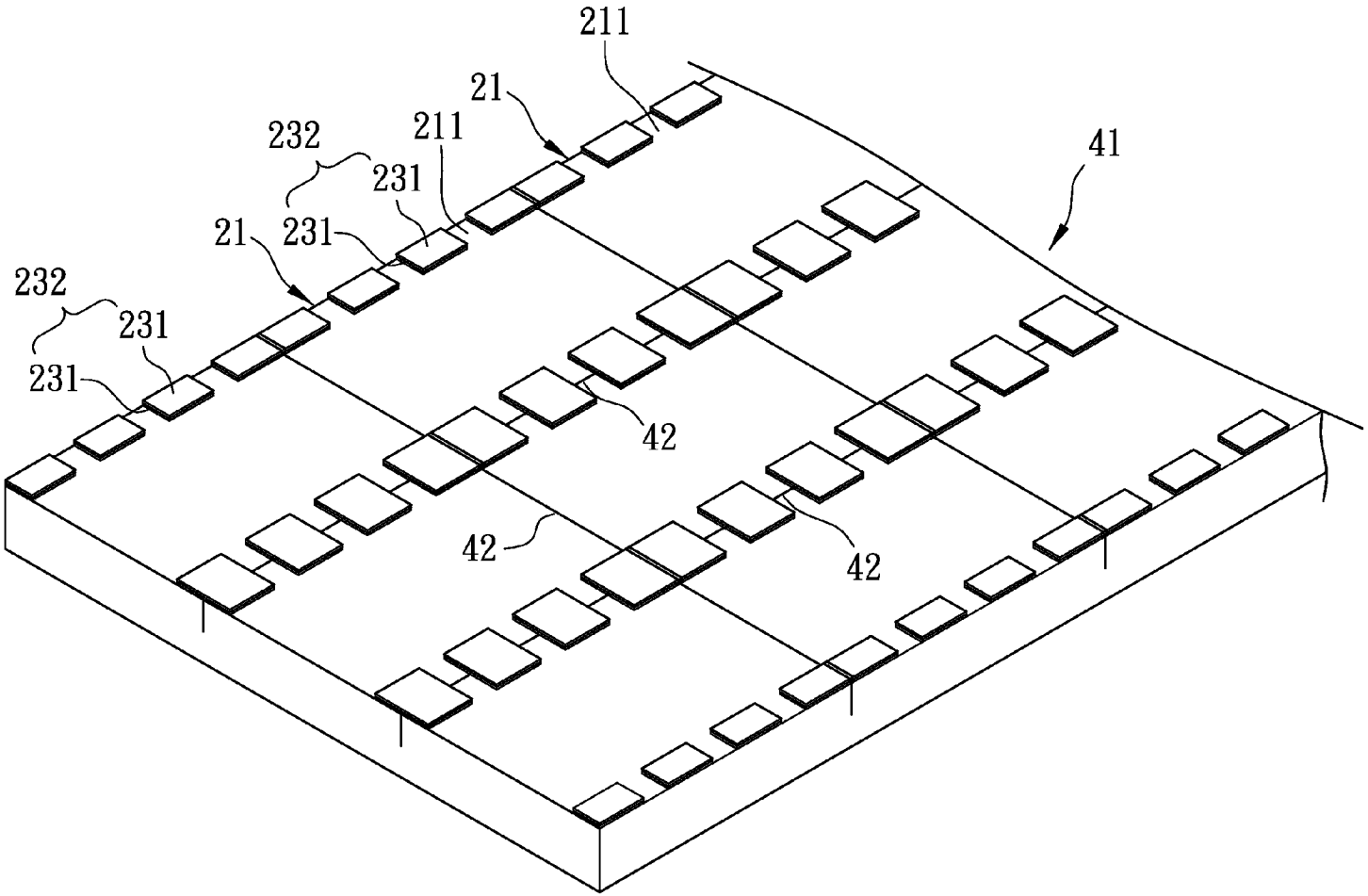
FIG. 8 is a schematic view illustrating a step for forming contact electrode growing films of the method for fabricating the chip resistor device of the first preferred embodiment.

Referring to FIGS. 5 and 8, in step 33, a first pasty conductive material is filled into the eight indented patterns 22 of each of the insulating substrates 21 so as to form four pairs of the contact electrode growing films 232 on the indented patterns 22 in the four pairs of the electrode forming regions 215. To be specific, the first pasty conductive material including, e.g., silver and palladium, is printed on the electrode forming regions 215 and fills the indented patterns 22, followed by baking so as to form a sub-film 231 on each of the indented patterns 22 in the electrode forming regions 215. Another sub-film 231 is formed on the aforesaid sub-film 231 using the same process so as to form each of the contact electrode growing films 232.

Figure 9:
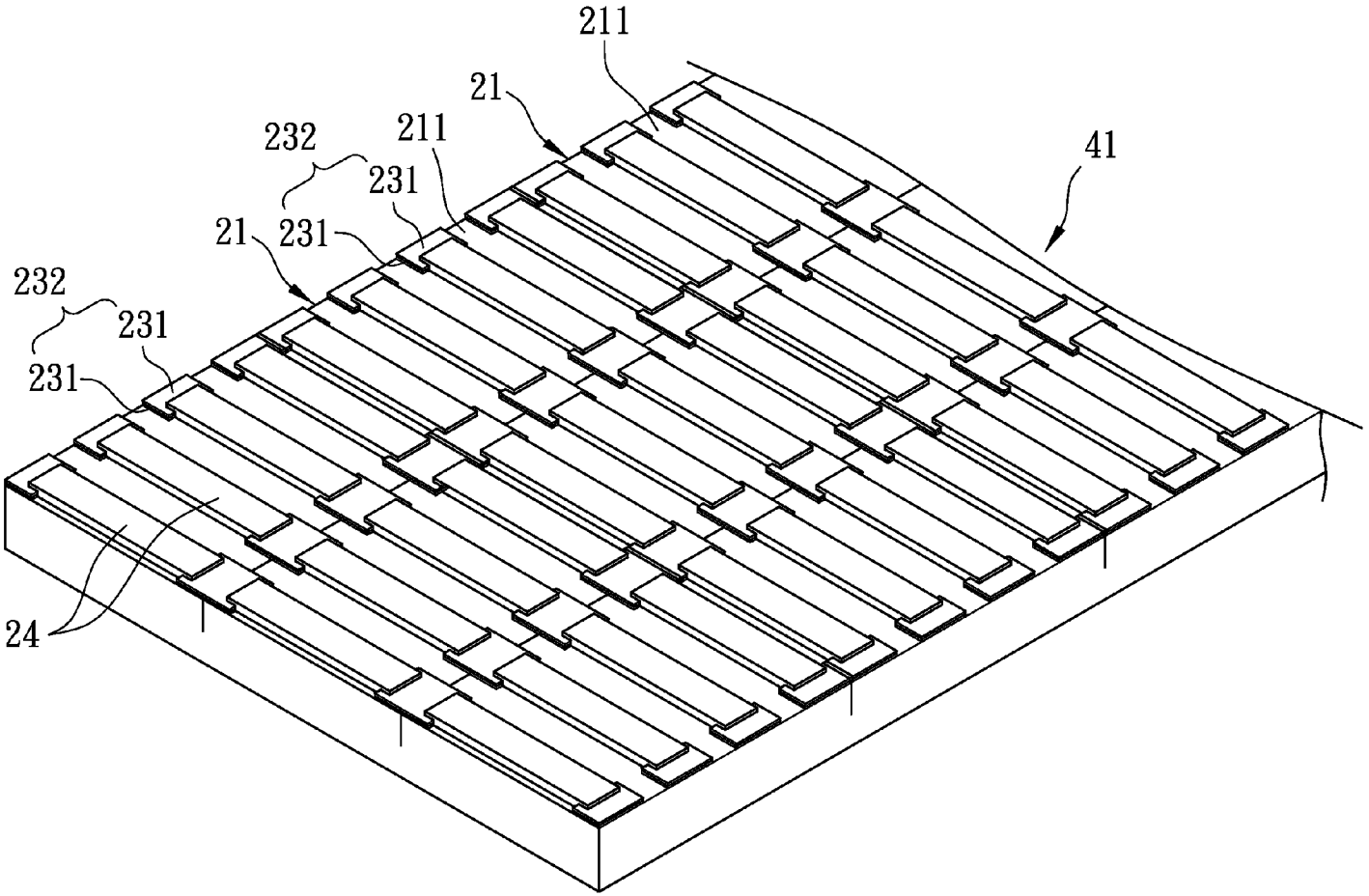
FIG. 9 is a schematic view to illustrate a resistor forming step of the method for fabricating the chip resistor device of the first preferred embodiment.

Referring to FIGS. 5 and 9, in step 34, four spaced-apart resistors 24 made of a second pasty conductive material such as ruthenium oxide ($RuO_2$) are respectively formed between the four pairs of the contact electrode growing films 232 on the first surface 211 of each of the insulating substrates 21. Each of the resistors 24 has two opposite ends electrically contacting a respective one of the pairs of the contact electrode growing films 232. In this embodiment, the second pasty conductive material is screen-printed between the contact electrode growing films 232 and baked so as to form the resistors 24.

Figure 10:
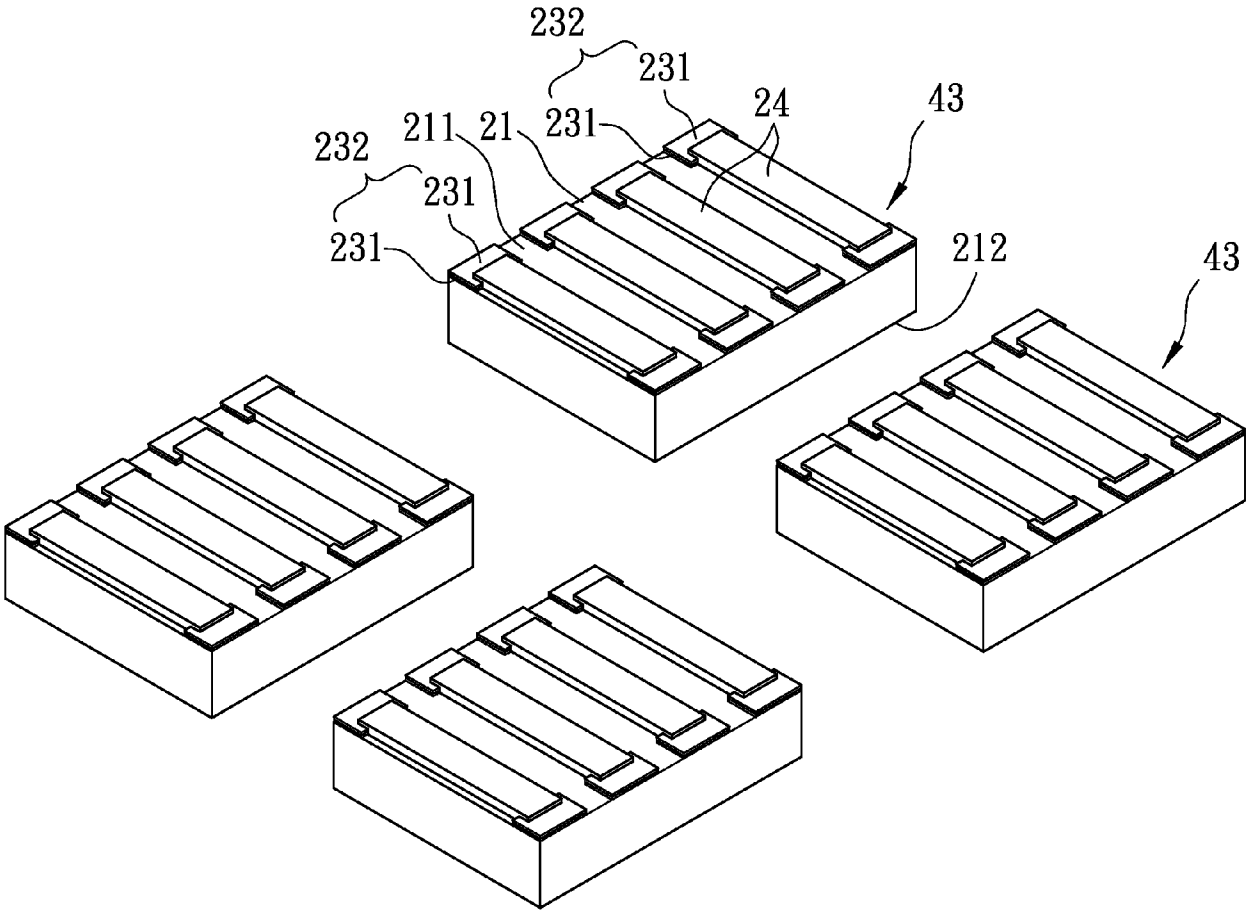
FIG. 10 is a schematic view to illustrate an insulating film cutting step of the method for fabricating the chip resistor device of the first preferred embodiment.

Referring to FIGS. 5 and 10, in step 35, the insulating film 41 is cut along the splitting grooves 42 so as to obtain a plurality of chip resistor semi-products 43 each of which includes the substrate 21, the four pairs of the contact electrode growing films 232 and the four resistors 24.

Figure 11:
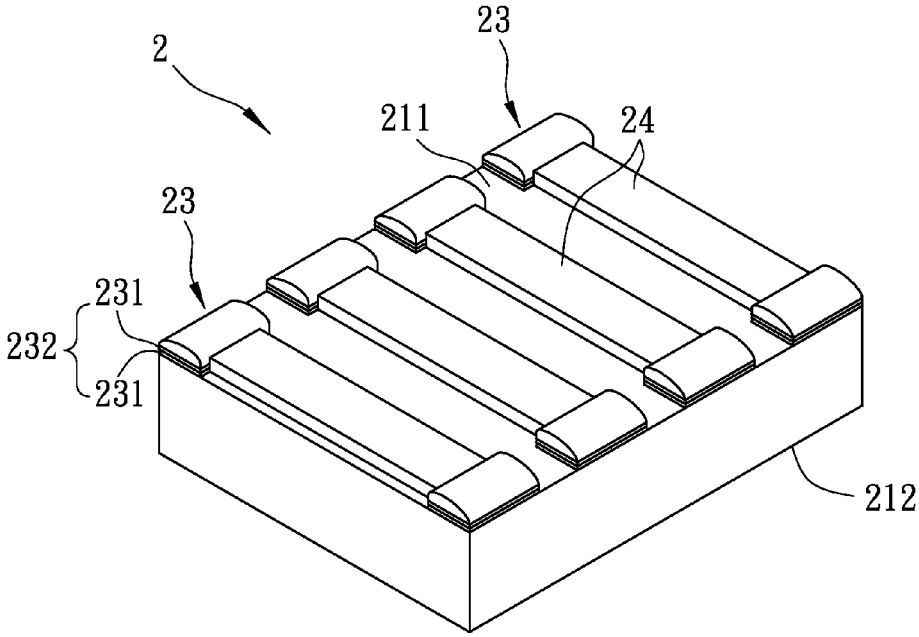
FIG. 11 is a schematic view to illustrate an electrode forming step of the method for fabricating the chip resistor device of the first preferred embodiment.

Referring to FIGS. 5 and 11, in step 36, the chip semi-products 43 are coated with a conductive material on the contact electrode growing films 232 of each of the insulating substrates 21 by electroplating so as to form eight contact electrodes 23 on the electrode forming regions 215 of each of the insulating substrates 21.

It should be noted that step 36 can be conducted before step 35.

Figure 12:
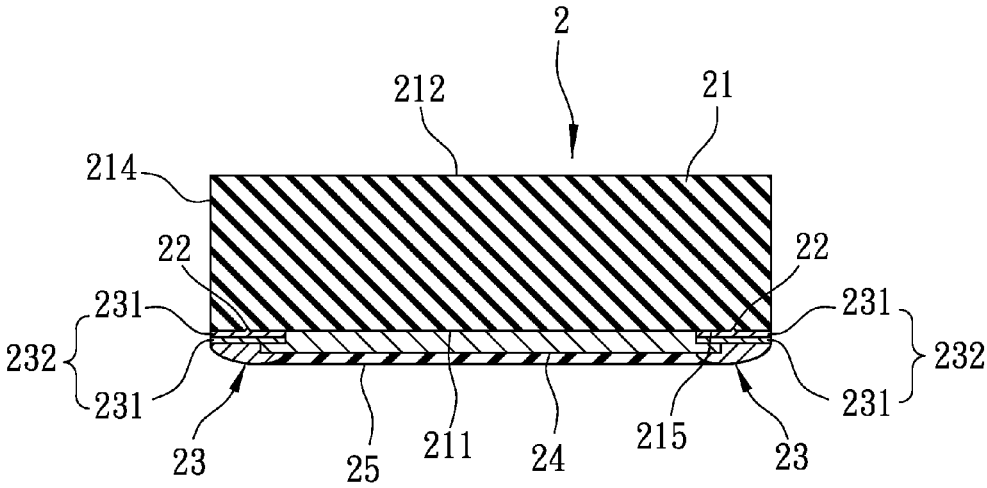
FIG. 12 is a sectional view of a chip resistor device of the second preferred embodiment according to this invention.

Referring to FIG. 12, a chip resistor device 2 of the second preferred embodiment according to this invention is similar to that of the first preferred embodiment except that, in this embodiment, the chip resistor device 2 further includes an insulating protection layer 25 which is made of glass or resin and which covers the resistors 24 to protect the resistor 24 from being damaged and to maintain resistance stability. Also, a laser trimming process can be conducted on the insulating protection layer 25 and the resistors 24 so as to adjust resistances of the resistors 24.

Figure 13:
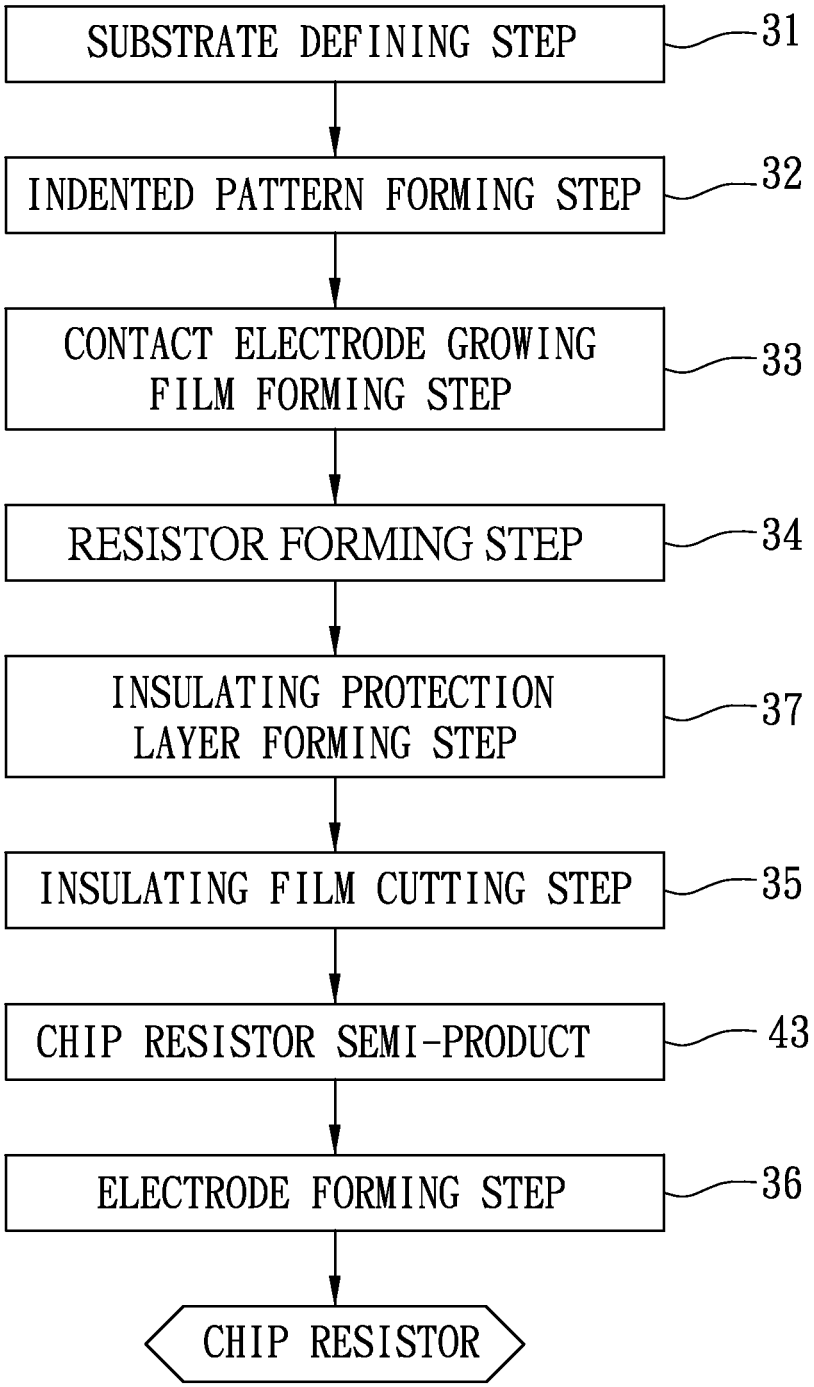
FIG. 13 is a flow chart of a method for fabricating the chip resistor device of the second preferred embodiment.

Referring to FIG. 13, a method for fabricating the chip resistor device 2 of the second preferred embodiment according to this invention is similar to that of the first preferred embodiment, except that the method in this embodiment further includes, between steps 34 and 35, an insulating protection layer forming step 37. In step 37, the insulating protection layer 25 is formed to cover the resistors 24 of each of the insulating substrates 21.

In this invention, with the indented patterns 22, the contact electrodes 23 could be firmly adhered to the insulating substrate 21, and thus, the contact electrodes 23 can be designed to be only formed on the first surface 211 of the insulating substrate 21, i.e., without extending the contact electrodes 23 to lateral surfaces or the second surface 212 of the insulating substrate 21. Thus, manufacturing costs and temperature coefficient of resistance (TCR) could be reduced. Moreover, since the electrode area is reduced in this invention, short circuit and collision risks and possible malfunction attributed thereto may be alleviated. Moreover, since no pin hole is formed in this invention, the chip resistor device 2 has a relatively large usable area, and problem of sintering deformation of the insulating substrate 21 can be eliminated. In this invention, usable area proportion for the insulating substrate 21 could be over 80%.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A method for fabricating a chip resistor device, comprising the steps of:

(a) defining a plurality of substrates on an insulating film by a plurality of spaced-apart and interlaced splitting grooves, each of the splitting grooves having a depth shorter than a thickness of the insulating film, each of the substrates having a first surface and a second surface opposite to the first surface, the first surface having two opposite edges and two electrode forming regions adjacent to the two opposite edges respectively;

(b) forming two indented patterns respectively in the electrode forming regions of the first surface of each of the substrates, the indented patterns being indented from the first surface;

(c) filling a first pasty conductive material into the two indented patterns so as to form two contact electrode growing films on the indented patterns of each of the substrates;

(d) forming a resistor made of a second pasty conductive material on the first surface of each of the substrates between the two contact electrode growing films, the resistor having two opposite ends electrically contacting the contact electrode growing films;

(e) cutting the insulating film along the splitting grooves; and (f) coating the contact electrode growing films of each of the substrates with a conductive material so as to respectively form two electrodes on the electrode forming regions of each of the substrates.

2. The method of claim 1, further comprising, between step (d) and step (e), a step (g) of forming and covering an insulating protection layer on the resistor on each of the substrates.

3. The method of claim 1, wherein, in step (b), forming of the two indented patterns is conducted using a diamond blade or laser.

* * * * *